US007712628B2

(12) United States Patent
Guindulain Vidondo

(10) Patent No.: US 7,712,628 B2
(45) Date of Patent: May 11, 2010

(54) ADVERTISING APPARATUS FOR VENDING MACHINES

(75) Inventor: Felix Guindulain Vidondo, Navarra (ES)

(73) Assignee: Jofemar, S.A., Peralta (Navarra) (ES)

( * ) Notice: Subject to any disclaimer, the term of this patent is extended or adjusted under 35 U.S.C. 154(b) by 150 days.

(21) Appl. No.: 11/510,279

(22) Filed: Aug. 25, 2006

(65) Prior Publication Data

US 2007/0089339 A1 Apr. 26, 2007

(30) Foreign Application Priority Data

Aug. 25, 2005 (ES) ..... 200502097

(51) Int. Cl.
*G09F 15/00* (2006.01)
*G09F 15/02* (2006.01)

(52) U.S. Cl. ..... 221/155; 221/277

(58) Field of Classification Search ..... 40/5, 40/111, 112, 115, 116, 117, 312, 349, 351, 40/375, 385, 436, 437, 438, 470, 500, 514, 40/515, 520, 606.02, 606.04, 611.1, 661; 221/2, 24, 9, 70, 76, 82, 101, 124, 127, 131, 221/151, 155, 921; 700/243
See application file for complete search history.

(56) References Cited

U.S. PATENT DOCUMENTS 516,884 A * 3/1894 Attaway ..... 40/508
1,812,621 A * 6/1931 Caller ..... 40/471
2,461,706 A * 2/1949 Szalka ..... 221/8
3,294,282 A * 12/1966 Brown ..... 221/12
3,754,342 A * 8/1973 Santacroce et al. ..... 40/477
3,938,269 A * 2/1976 Catteau ..... 40/601
4,108,333 A * 8/1978 Falk et al. ..... 221/13
4,162,585 A * 7/1979 Decaux ..... 40/518
4,687,119 A * 8/1987 Juillet ..... 221/101
5,488,791 A * 2/1996 Boni ..... 40/467
5,953,840 A * 9/1999 Simson et al. ..... 40/471
5,966,854 A * 10/1999 Walsh et al. ..... 40/514
6,055,754 A * 5/2000 Melhuus ..... 40/601
6,195,924 B1 * 3/2001 Rudick et al. ..... 40/515
6,357,621 B1 * 3/2002 Guindulain Vidondo ..... 221/85
6,659,159 B2 * 12/2003 Fritsche et al. ..... 160/371
6,691,441 B1 * 2/2004 Crivelli et al. ..... 40/471
6,719,168 B2 * 4/2004 Nicolini ..... 221/85
6,794,634 B2 * 9/2004 Hair et al. ..... 250/223 R (Continued)

*Primary Examiner*—Gene Crawford
*Assistant Examiner*—Kelvin L Randall, Jr.
(74) *Attorney, Agent, or Firm*—Klauber & Jackson, LLC

(57) ABSTRACT

Advertising apparatus for vending machines, mainly of the type of those which have a glass front which allows the products to be seen presented in the different compartments of the plurality of storage trays and from which compartments they are delivered to a reception tray formed in an ascending/descending body, by way of an elevator, for their carriage to the delivery box for collection by the user, so that to the ascending/descending body (7), proximate to the internal face of the glass door (2) of the machine (1), is fastened, by one of its sides, a laminar element (9) that holds publicity, which laminar element (9) on its opposing side is fastened to and wound on a winding roller (10), which is driven by a spring tending to cause its rotation and the winding of the laminar element (9), the laminar element (9) in the unwinding thereof remaining abutting on the internal face of the glass front (3) of the machine door.

4 Claims, 5 Drawing Sheets

U.S. PATENT DOCUMENTS

| | | | | |
|---|---|---|---|---|
| 6,991,019 | B2 * | 1/2006 | Chang | 160/24 |
| 7,337,567 | B2 * | 3/2008 | Fritsche et al. | 40/603 |
| 2001/0000609 | A1 * | 5/2001 | Rudick et al. | 221/6 |
| 2002/0145003 | A1 * | 10/2002 | Nicolini | 221/191 |
| 2004/0025389 | A1 * | 2/2004 | Peterson | 40/524 |
| 2004/0140317 | A1 * | 7/2004 | Forte | 221/123 |
| 2005/0060062 | A1 * | 3/2005 | Walker et al. | 700/236 |

* cited by examiner

ADVERTISING APPARATUS FOR VENDING MACHINES

CROSS REFERENCE TO RELATED APPLICATIONS

The present application claims priority from Spanish Application Serial No. 200502097, filed on Aug. 25, 2005. Applicants claim priority under 35 U.S.C. §119 as to the said Spanish application, and the entire disclosure of said application is incorporated herein by reference in its entirety.

OBJECT OF THE INVENTION

The following invention, as stated in the title piece of the presented descriptive specification, relates to an advertising apparatus for vending machines, being of special utility in those vending machines of products which have a glass front which allows the products to be seen presented in the different compartments of the plurality of storage trays and from which they are dispatched to a reception tray formed in an ascending/descending body, by way of an elevator, for their carriage to the delivery box for collection by the user, having as objective to display an advertisement in the operations of dispatching the products when requested by the users, allowing an additional economic benefit to be obtained.

Thus, the ascending/descending body for reception of the products to be dispatched for their carriage to the delivery box for collection is associated with a laminar element, holder of the advertisement, so that in the event of a product being requested by a user in the ascending movement thereof the laminar element is unwound with respect to the glass front, whilst in the descending movement thereof the laminar element is rewound on the corresponding winding roller.

In addition, the machine can be programmed so that the ascending/descending body associated with the laminar advertising element is activated regularly, for the purpose of displaying the advertisement, at a programmed interval of time.

FIELD OF APPLICATION

In the present specification an advertising apparatus is described for vending machines, being of special application in those vending machines of products which have the products to be dispatched located in different compartments of the plurality of storage trays, which products are dispatched to a reception tray for their carriage to the delivery box for collection, so that the front part of the machine is glazed in the greater part of its surface.

BACKGROUND OF THE INVENTION

It is known that on the market there exists a great diversity of automatic vending machines which work by the insertion of coins, notes or cards, so that, generically, a distinction can be drawn between those machines which have an opaque front, with whatever decorative or advertising motif, and the machines which have a glass front which allows the products stored inside to be seen.

Thus, those machines which have a glass front are usually vending machines of foodstuffs in which the products are located in a series of compartments of a plurality of storage trays, the compartments for housing the products being directed toward the front of the machine, allowing the user to see the diversity of products to be dispatched by selecting that desired from those present.

In addition, in this type of vending machine the selected product, from the corresponding housing compartment falls directly toward the delivery box for collection located in the bottom part of the machine.

Furthermore, we can consider the Patent of Invention P200501205 for: "unitary extractor system of products", by the same party holding the present application, which is based on a vending machine fitted with a glass front and equipped with a plurality of trays for storage of the products in a series of compartments and a reception tray of the dispatched product formed in an ascending-descending body, by way of an elevator, relative to the internal face of the glass front.

Thus, when a user proceeds to the selection of a product, in the first place, the ascending-descending body will be positioned relative to the corresponding tray to receive the respective product and be carried to the delivery box for collection.

In this way, based on this constitution the present invention has been conceived with the object of obtaining a greater efficiency in the use of the machine.

DESCRIPTION OF THE INVENTION

Based on the background cited in the present specification an advertising apparatus is described for vending machines, being of special utility in those vending machines of products which have a glass front which allows the products to be seen present in the different compartments of the plurality of storage trays and from which they are dispatched to a reception tray formed in an ascending/descending body, by way of an elevator, for their carriage to the delivery box for collection by the user.

Thus, to the ascending/descending body, proximate to the internal face of the glass door of the machine, is fastened, by one of its sides, a laminar element holding publicity which laminar element by its opposite side is fastened to and winds on a winding roller, said winding roller being driven by a spring tending to cause the rotation thereof and the winding of the laminar element, the laminar element in the unwinding thereof remaining abutting upon the internal face of the glass front of the machine door.

The laminar element holding publicity is guided by a bottom axle mounted in the same vertical plane as its fastening to the ascending/descending body and being carried, the aforesaid laminar element, according to a horizontal plane from the guiding bottom axle to the winding roller displaced toward the interior of the machine.

Thus, on requesting a product, the operating means of the machine cause the dispatch operation to begin, the body in which the reception tray of the products is formed, from its idle bottom position, initiating an ascending motion toward the storage tray of the requested product, and, when received, be carried to the delivery box for collection, so that in the ascending motion of the ascending/descending body the unwinding of the laminar element takes place relative to the glass front of the machine.

Once the product requested by a user has been dispatched to the reception tray formed in the ascending/descending body it has to be carried to the delivery box for collection by the user, so that the delivery box for collection can be in a position above or below that of the tray in which the dispatched product was located.

In the descending motions of the body in which the reception tray of the products is formed from the corresponding compartment of the plurality of storage trays for its carriage to the delivery box for collection, the winding takes place of the laminar element on the winding roller driven by a spring.

Moreover, the body in which the reception tray of the products is formed from the corresponding compartment of the plurality of storage trays for the carriage thereof to the delivery box for collection, can be programmed so that it is regularly displaced in an ascending/descending motion to display the publicity.

To complete the description which is provided below, and with the object of assisting in a better understanding of the characteristics of the invention, this descriptive specification is accompanied with a set of drawings in the figures of which, by way of illustration and not restrictively, the most characteristic details in the invention are shown.

DESCRIPTION OF A PREFERRED EMBODIMENT

Figure 1:
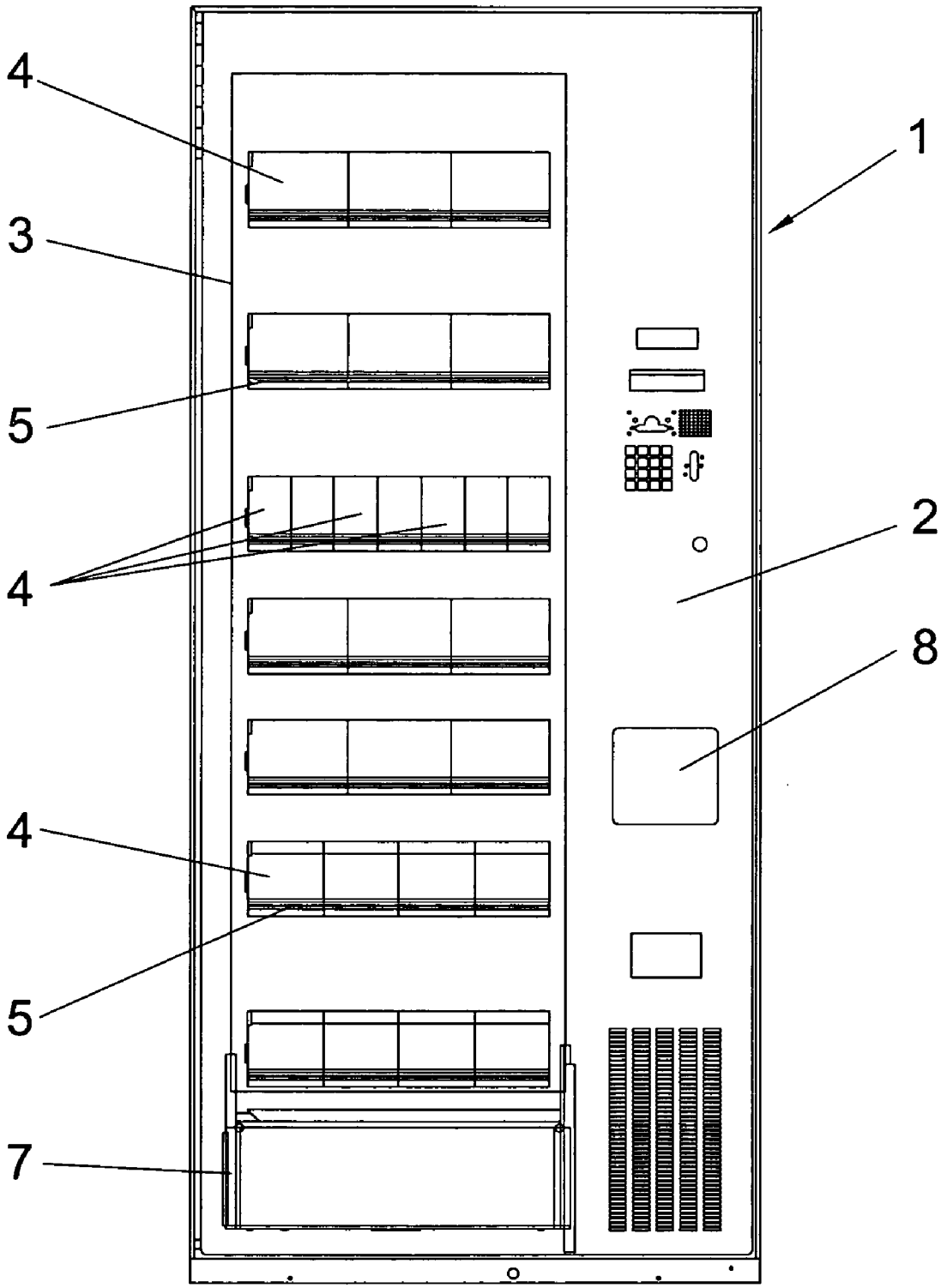
FIG. 1. It shows a front view of a vending machine, it being possible to observe how the door has the greater part of its surface glazed, there being in its bottom part, represented with dotted lines, an ascending/descending body in which is formed a reception tray of the products, whilst the products located in the different compartments of the plurality of storage trays are visible.
Figure 2:
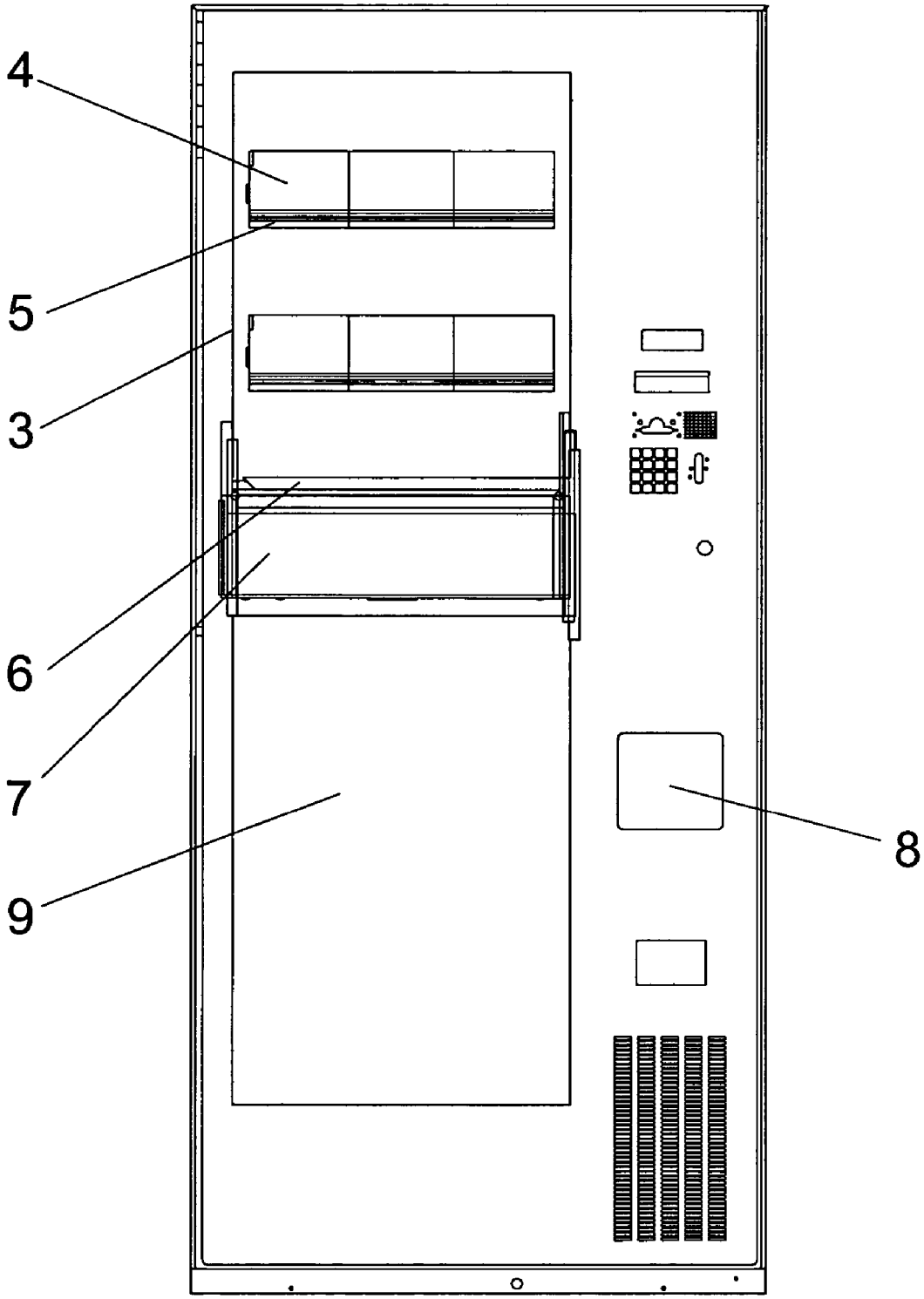
FIG. 2. It shows a front view of the machine of the previous figure, it being possible to observe how the ascending/descending body has been displaced in an ascending motion causing the partial unwinding of the laminar element holding the advertisement.
Figure 3:
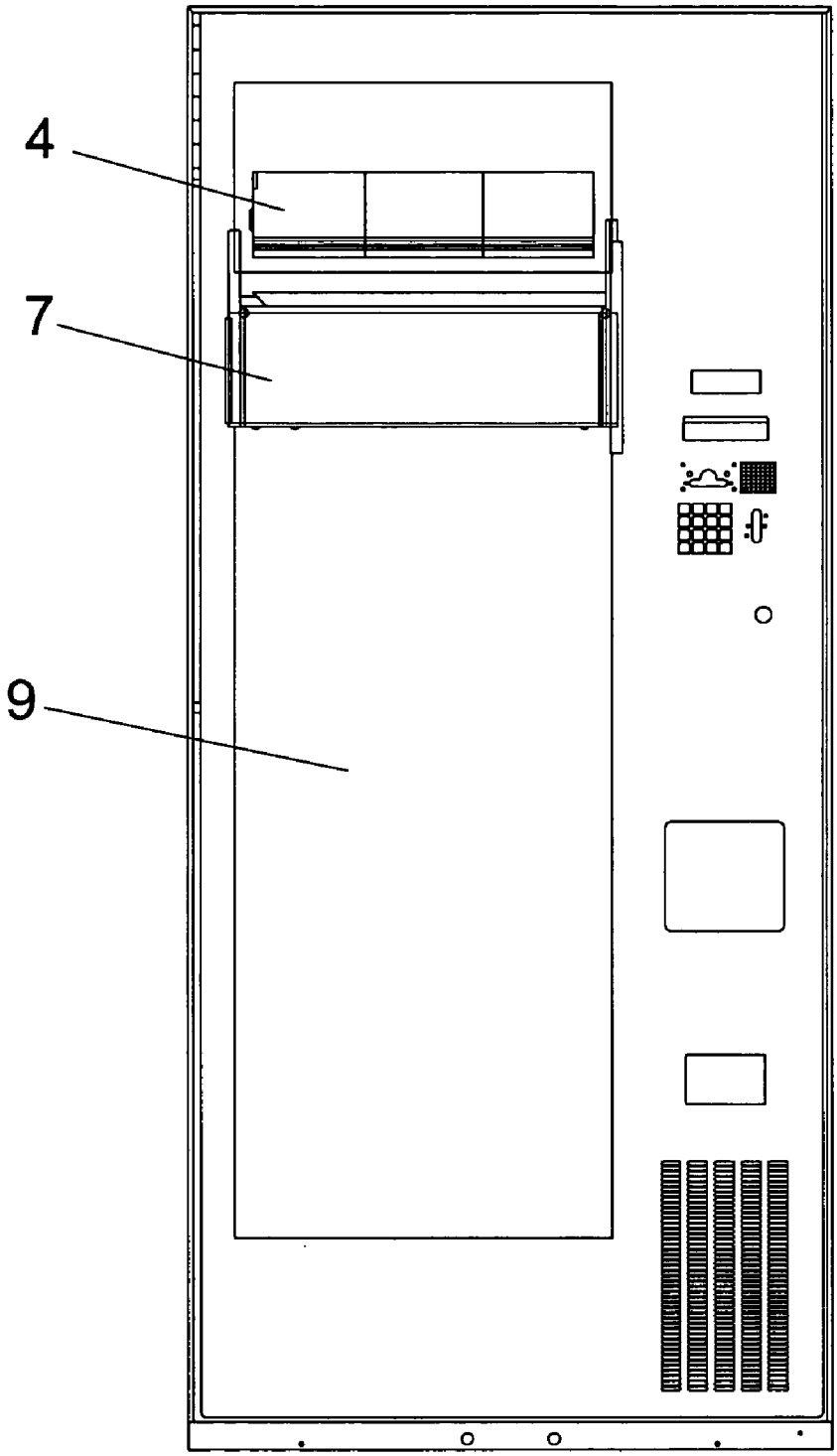
FIG. 3. It shows a front view of the machine of the previous figure, it being possible to observe how the ascending/descending body is in a higher position continuing in the ascending displacement thereof with the unwinding of the laminar element holding the advertisement.

In view of the aforementioned figures and in accordance with the numbering adopted it can be observed how the vending machine 1 of products has a front door 2 with a glass front 3, on the greater part of its surface which allows the products to be seen present in the different compartments 4 of the plurality of storage trays 5 and from which compartments 4 they are dispatched to a reception tray 6 formed in an ascending/descending body 7, by way of an elevator, for their carriage to the delivery box 8 for collection by the user.

Thus, the ascending/descending body 7 is proximate to the internal face of the glass front 3 of the door 2 of the machine 1, so that to the aforementioned body 7 is fastened, by one of its sides, a laminar element 9 holding publicity, which laminar element 9 by its opposite side is fastened to and winds on a winding roller 10. Said winding roller 10, of a known type, is driven by a spring tending to produce its rotation and the winding of the laminar element 9 by applying a continuous pull on the laminar element 9.

Moreover, laminar element 9 holding publicity is guided by a bottom axle 11 mounted in the same vertical plane as its fastening to the ascending/descending body 7 and being transported, the aforementioned laminar element 9, according to a horizontal plane from the guiding bottom axle 11 to the winding roller 10 displaced toward the interior of the machine.

In this way, when a product is required, in the ascending motion of the body 7 in which the tray 6 is formed for reception of the products from the corresponding compartment 4 of the plurality of storage trays 5 for the carriage thereof to the delivery box for collection 8, the unwinding takes place of the laminar element 9, the laminar element 9 remaining, in its unwinding, abutting upon the internal face of the glass front 3 of the door 2 of the machine 1.

Figure 4:
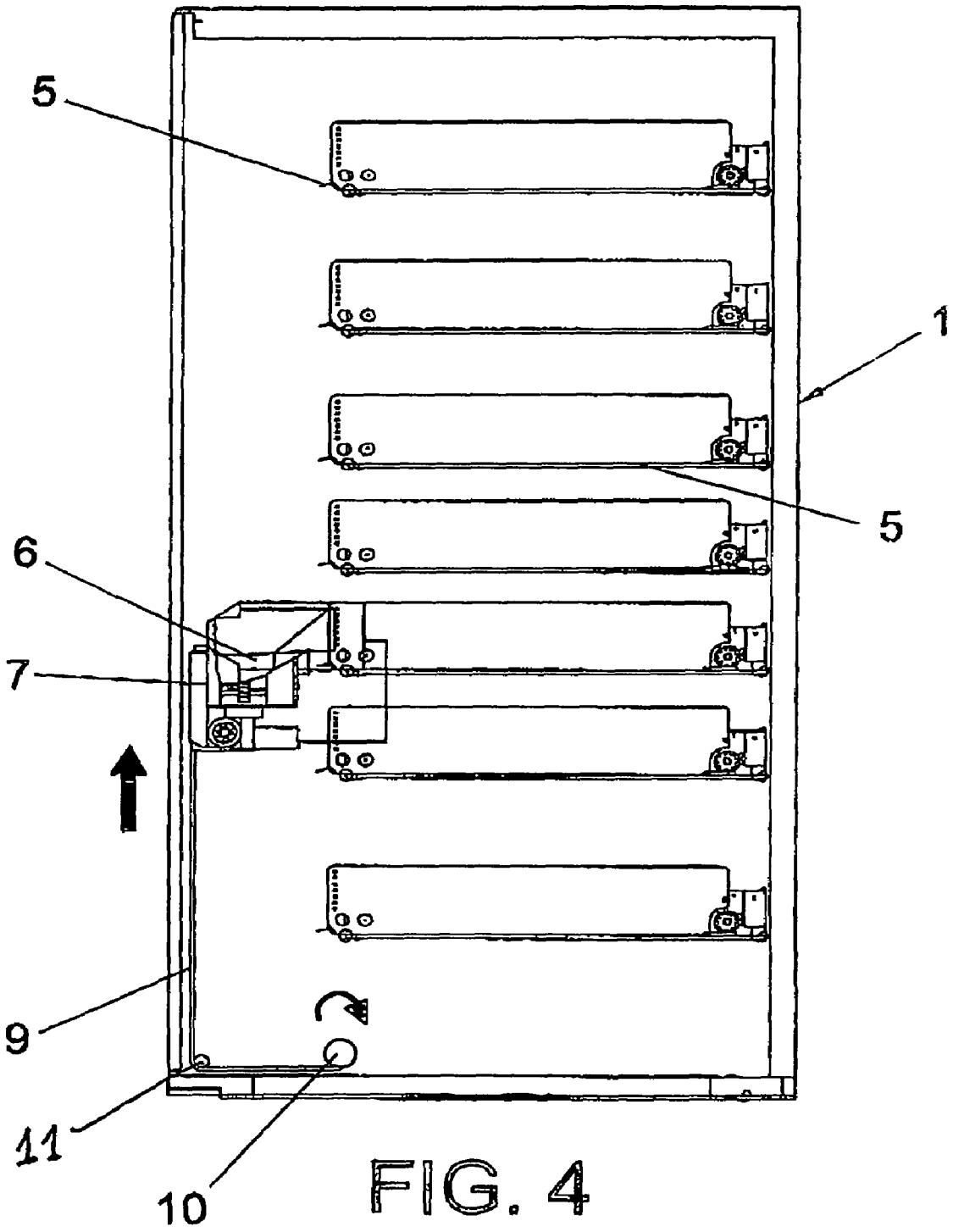
FIG. 4. It shows a side view of the interior of the vending machine of the previous figures, it being possible to observe how to the ascending/descending body is fastened the laminar element holding the publicity which at the bottom is guided by an axle, the direction of rotation of the winding roller having been shown on producing the unwinding of the laminar element through the ascent of the ascending/descending body.
Figure 5:
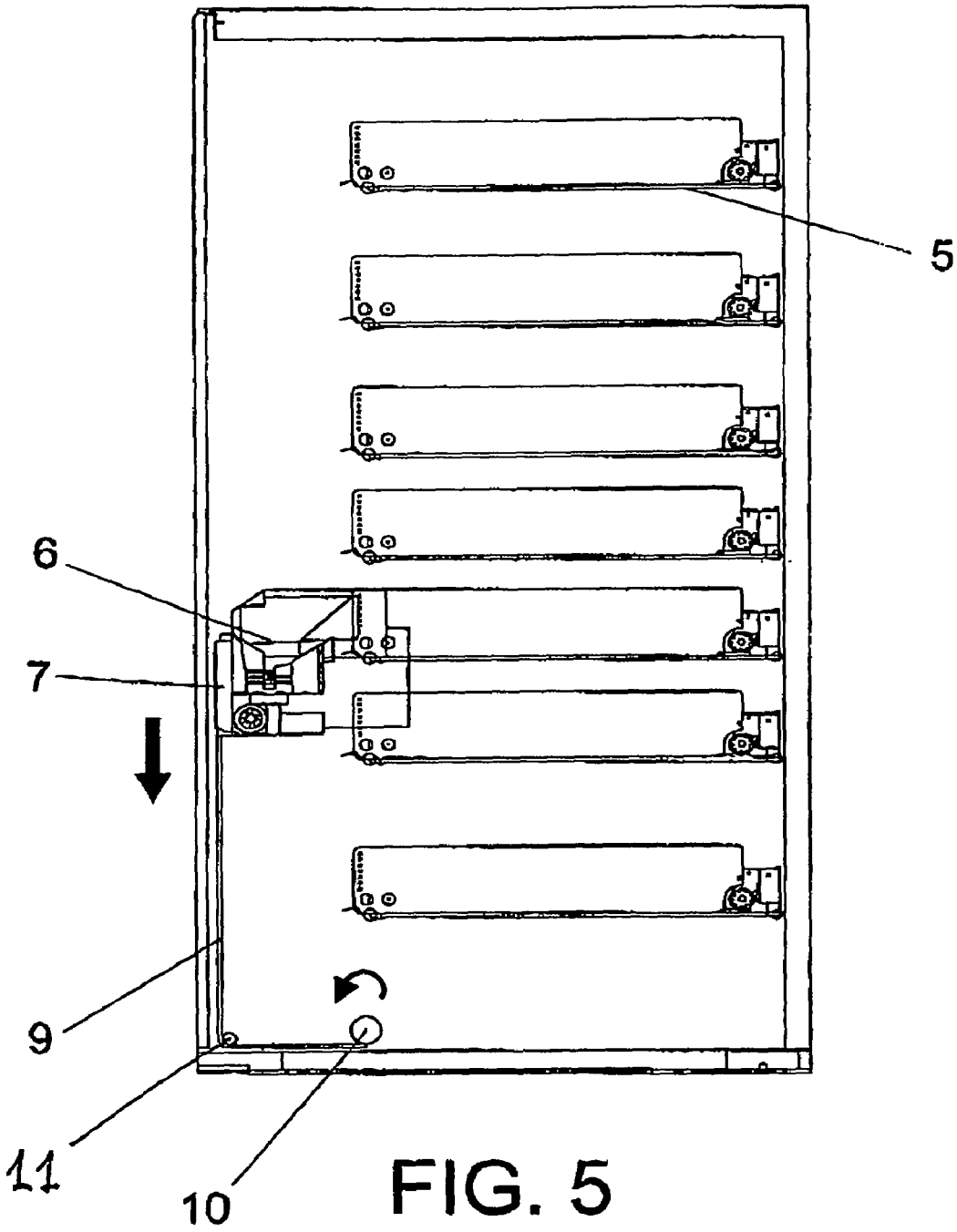
FIG. 5. It shows a side view of the interior of the vending machine of the previous figures, it being possible to observe how when the ascending/descending body descends, the laminar element holding the publicity, being relieved of tension, is wound on the winding roller, driven by a spring, according to the direction of rotation shown.

Thus, in accordance with FIG. 4 of the drawings, when the body 7 ascends, it pulls the laminar element 9 causing the unwinding thereof, whilst, when the body 7 descends the tension that the spring applies on the winding roller 10 causes the laminar element 9 to wind on to the latter, as is observed in FIG. 5 of the drawings.

By means of the incorporation of the disclosed advertising apparatus, it is possible to obtain a greater economic return in the operation of the machine, the appearance of the machine itself being also improved.

The invention claimed is:

1. A vending machine comprising:

a transparent glass front for viewing there-through;

a plurality of storage trays and compartments located within said vending machine for storing a plurality of products;

an ascending/descending body having a reception tray for receiving said products therein;

a delivery box to which the ascending/descending body carries products for collection by the user; and a laminar element having a first side attached to the ascending/descending body, and a second side winding and unwinding upon a bottom winding roller during dispensing of the products, such that the storage trays are visible through a portion of the transparent glass front located above the ascending/descending body, while the laminar element is visible through a portion of the transparent glass front located below the ascending/descending body.

2. Vending machine according to claim 1, which further comprises a bottom axle located below the ascending/descending body for guiding the laminar element to the bottom winding roller.

3. Vending machine according to claim 2, wherein the bottom axle and the bottom winding roller are located in the same horizontal plane.

4. Vending machine according to claim 1, wherein the ascending/descending motion of the ascending/descending body is programmable for regularly displaying the laminar element holding publicity.

* * * * *